United States Patent [19]

MacLeod et al.

[11] Patent Number: 4,821,489

[45] Date of Patent: Apr. 18, 1989

[54] METHOD AND APPARATUS FOR SEALING A FLEXIBLE BAG TO A PALLET

[75] Inventors: Richard F. MacLeod; Kevin J. Bolejack, both of Salinas, Calif.

[73] Assignee: TransFRESH Corporation, Salinas, Calif.

[21] Appl. No.: 428,087

[22] Filed: Sep. 29, 1982

[51] Int. Cl.[4] ..... B65B 11/04

[52] U.S. Cl. ..... 53/419; 53/399; 53/459; 53/139.3; 53/587; 53/570

[58] Field of Search ..... 53/419, 399, 139.3, 53/587, 459, 570

[56] References Cited

U.S. PATENT DOCUMENTS

| | | | |
|---|---|---|---|
| 1,714,532 | 5/1929 | Walter | 53/587 |
| 2,057,061 | 10/1936 | Eggerss | 53/139.3 |
| 2,504,059 | 4/1950 | Weber | 53/139.3 |
| 2,563,542 | 8/1951 | Mackelduff | 53/139.8 |
| 2,840,968 | 7/1958 | Clement | 53/587 X |
| 2,893,188 | 7/1953 | Cook | 53/587 |
| 2,893,189 | 7/1959 | Lancaster | 53/587 |
| 2,972,843 | 2/1961 | Du Broff | 53/389 X |
| 3,853,218 | 12/1974 | Grasvoll | 53/463 |

FOREIGN PATENT DOCUMENTS 2954965 11/1980 Fed. Rep. of Germany ..... 53/587

*Primary Examiner*—John Sipos

*Attorney, Agent, or Firm*—George J. Netter

[57] ABSTRACT

Produce packages are stacked onto a pallet having an underlying gasproof plastic sheeting. The loaded pallet is placed on a rotatable table and a plastic bag is lowered over the produce which has its lower edges located partway down over the upturned portions of the plastic sheeting and onto the rim of the pallet. Two rolls of tape mounted at different heights on vertical spindles closely adjacent the table provide two tape strips with an edge portion overlapping. An idler roller joins the two strips of tape together in a single composite tape strip. The composite tape strip is applied by a pressure roller along the lower edge of the plastic bag and the pallet. After a full revolution of the table is completed, the tape is cut and the bag is completely sealed to the pallet. A lever arm on the pressure roller is spring-loaded to maintain the tape compressingly contacting the plastic bag and pallet throughout the full range of table rotation. Artificial gaseous environment is then provided to sealed container.

6 Claims, 4 Drawing Sheets

FIG. 1.
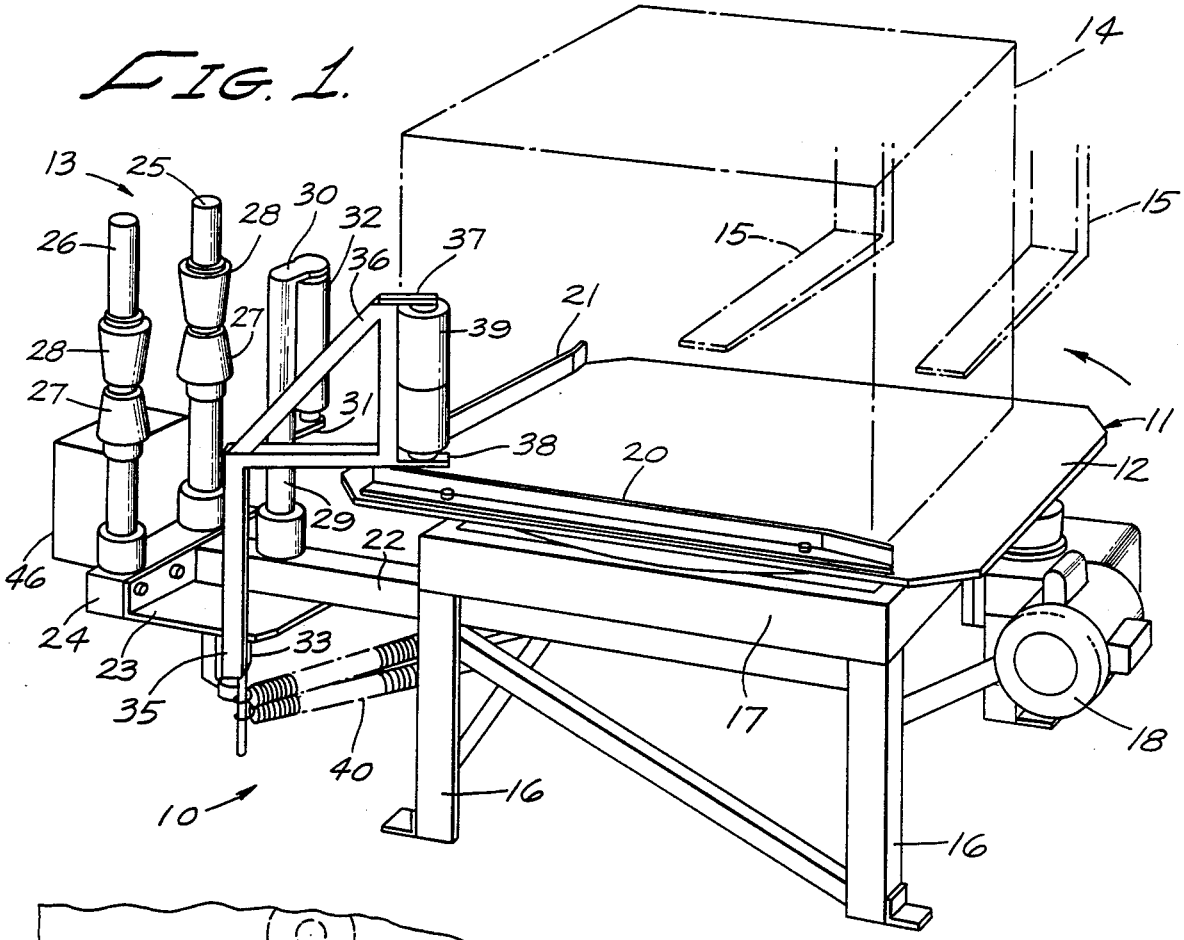
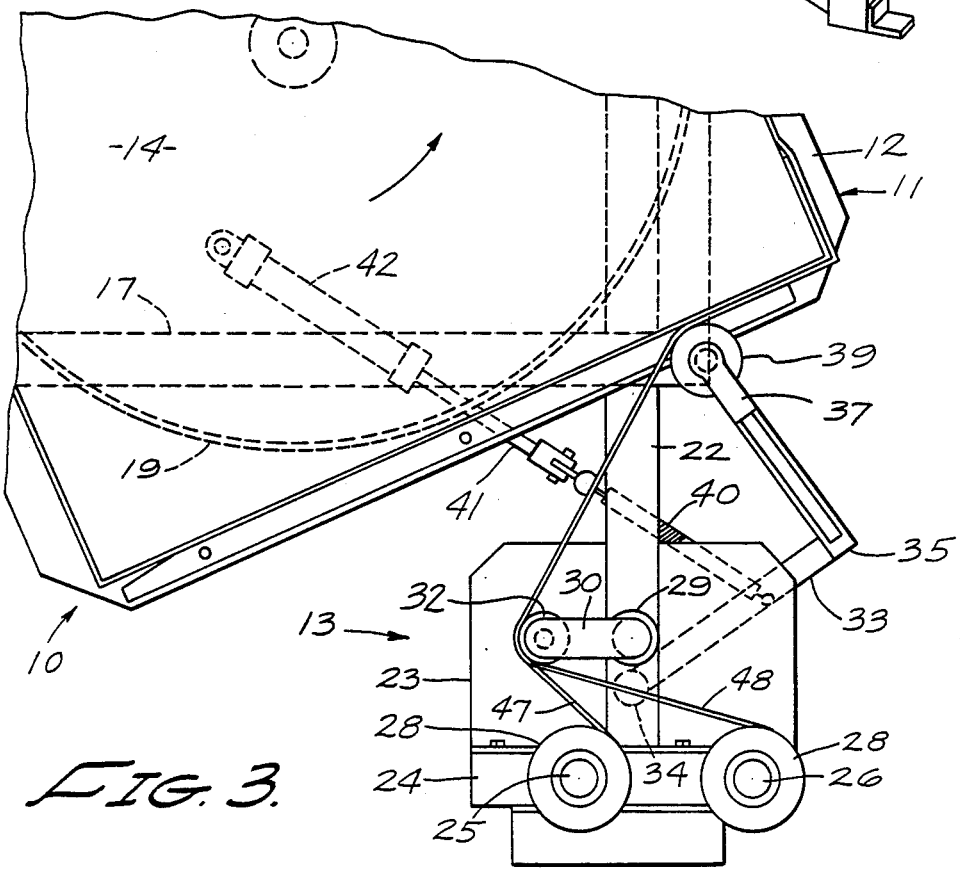
FIG. 3.

METHOD AND APPARATUS FOR SEALING A FLEXIBLE BAG TO A PALLET

The present invention relates generally to the provision and maintenance of a prescribed environmental atmosphere to a container for foodstuffs and, more particularly, to a method and apparatus for sealing a plastic cover onto a pallet loaded with foodstuffs forming a pallet based container of prescribed environmental gaseous contents.

BACKGROUND

Many foodstuffs, such as fresh produce (e.g., strawberries, lettuce, tomatoes, cauliflower), can have their fresh appearance maintained for a substantial period of time by controlling the gaseous environment of the package within which they are contained. In this way, losses during shipment and storage can be significantly reduced and thereby insuring that a larger percentage of fresh produce can be delivered to the customer in acceptable purchasable condition.

Many kinds of fresh produce, a primary one being strawberries, have been shipped in the past by storing a quantity of such boxes on a pallet base, with the entire load being enclosed by a plastic bag that is sealed to the base. U.S. Pat. No. 4,055,931, discloses the providing of a special atmosphere into the containing space formed by the plastic bag by first pulling a vacuum on the bag, then inserting a sharp-ended nozzle through the plastic sheeting and adding pressurized gases to the interior on a timed basis.

As fresh produce ripens, it gives off certain gases which tend, by themselves, if the package is totally sealed to provide a continuing change of the gaseous content of the package. In the past, to compensate for the production of gases by the aging of the produce, plastic bags have been made of sheet plastic that will permit migration of, say, oxygen or other selected gaseous molecules through the plastic bag and in that way prevent the internal accumulation of that gas to an undesirable high level. However, in order to control the interchange of a gas through the plastic envelope of the produce package, it is important that there be no macroscopic leaking of gas through tears in the bag wall or openings between the bag sheeting and the pallet base. That is, for this approach to work on a practical scale, it is important that edges of the plastic sheeting be sealed to the base with no gaps or interstices that would permit relatively large amounts of gas to leak therepast.

Various approaches have been taken in the past to securing the plastic bag over the produce and onto the pallet base, but all have been found unsatisfactory in one respect or another. Hand taping, where workmen pull off a length of tape and place it onto the lower edge of the plastic sheeting and also onto the base itself, is just too unreliable for a quantity production process. Specifically, hand-taping tends to produce an unacceptably high incidence of tape wrinkling and partial adhesion of the tape to plastic bag and pallet base via which gas can escape. Other sealing techniques such as one-sided heat sealing and impulse heat sealing have been attempted and found impractical from a cost and efficiency standpoint, and failure to provide an atmospheric seal under commercial conditions.

SUMMARY OF THE INVENTION

In the practice of the present invention, the produce is stacked in one or more boxes onto a pallet base having an oversize, gasproof plastic sheeting integrally related to the pallet base upper surface. The loaded pallet is placed on a rotatable table having a generally horizontal upper surface and a plastic bag is lowered over the produce which has its lower edges located to extend partway down over the turned portions of the plastic sheeting and onto the rim of the pallet base. Two rolls of tape are mounted at different heights on vertical spindles closely adjacent the rotating table and are located so that when the tape is pulled off the spindles, the two tape strips will have an edge portion in overlapping relationship with each other. An idler roller engages the two strips of tape at two different predetermined angles joining them together in a single composite tape strip. The composite tape strip is applied by a pressure roller along the lower edge of the plastic bag and the upturned plastic sheeting edge. After a full revolution of the table is completed, then the tape is cut and the bag is completely sealed to the plastic sheeting. A lever arm on the pressure roller is spring-loaded so as to maintain the tape compressingly contacting the plastic bag and pallet throughout the full range of table rotation.

With the bag sealed a sharp-ended nozzle punctures the bag, a vacuum is pulled to removed residual air and a prescribed pressurized gas is injected into the bag. The nozzle is then removed and the opening in the bag taped closed.

DESCRIPTION OF THE DRAWING

FIG. 1 is a perspective view of one form of apparatus for sealing a bag to a pallet in accordance with the described method.

FIG. 3 is a further plan view, partially fragmentary, similar to FIG. 3 and taken at a different stage of sealing.

DESCRIPTION OF PREFERRED EMBODIMENTS

Figure 2:
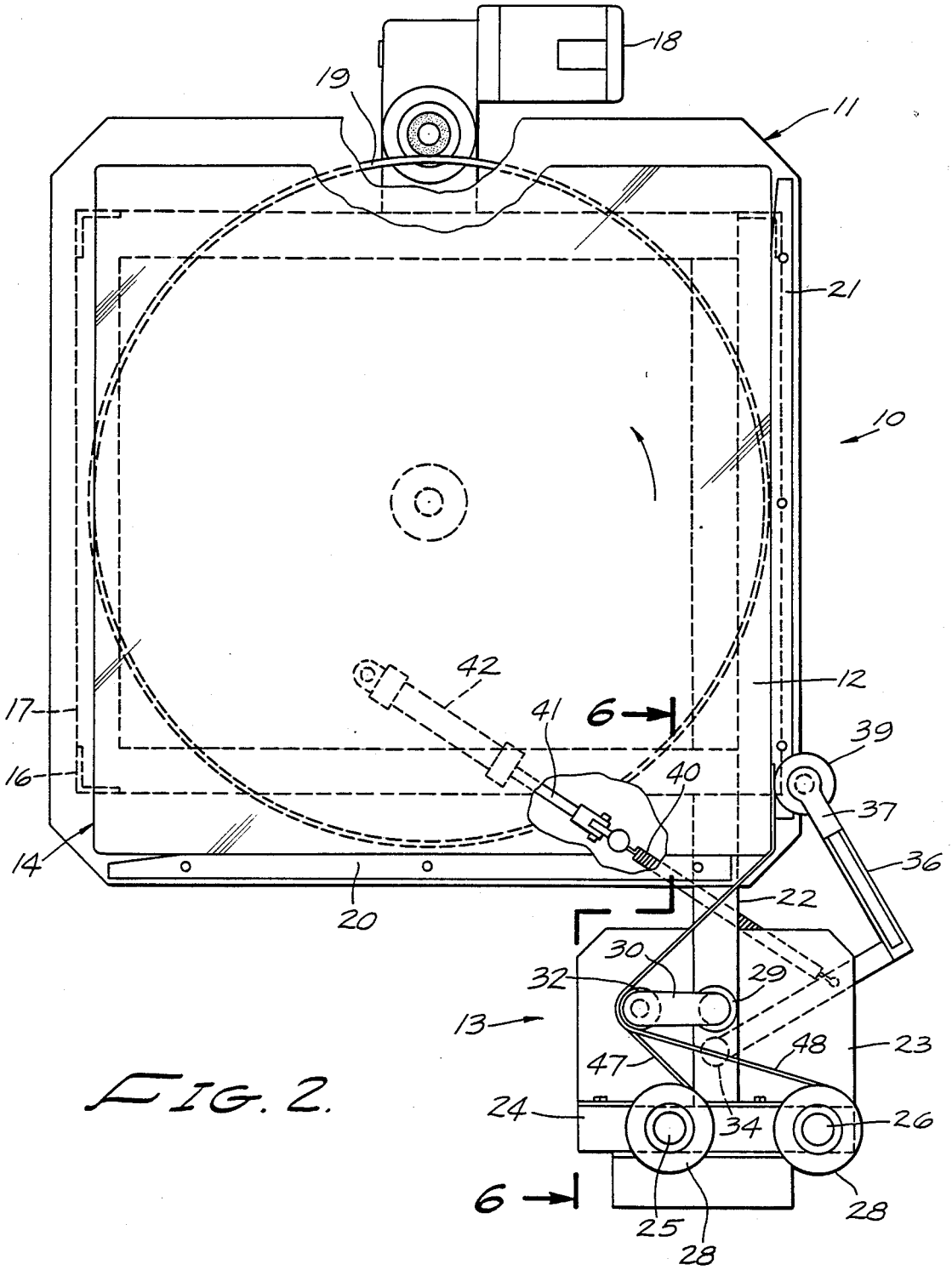
FIG. 2 is a plan view of the apparatus of FIG. 1.
Figure 4:
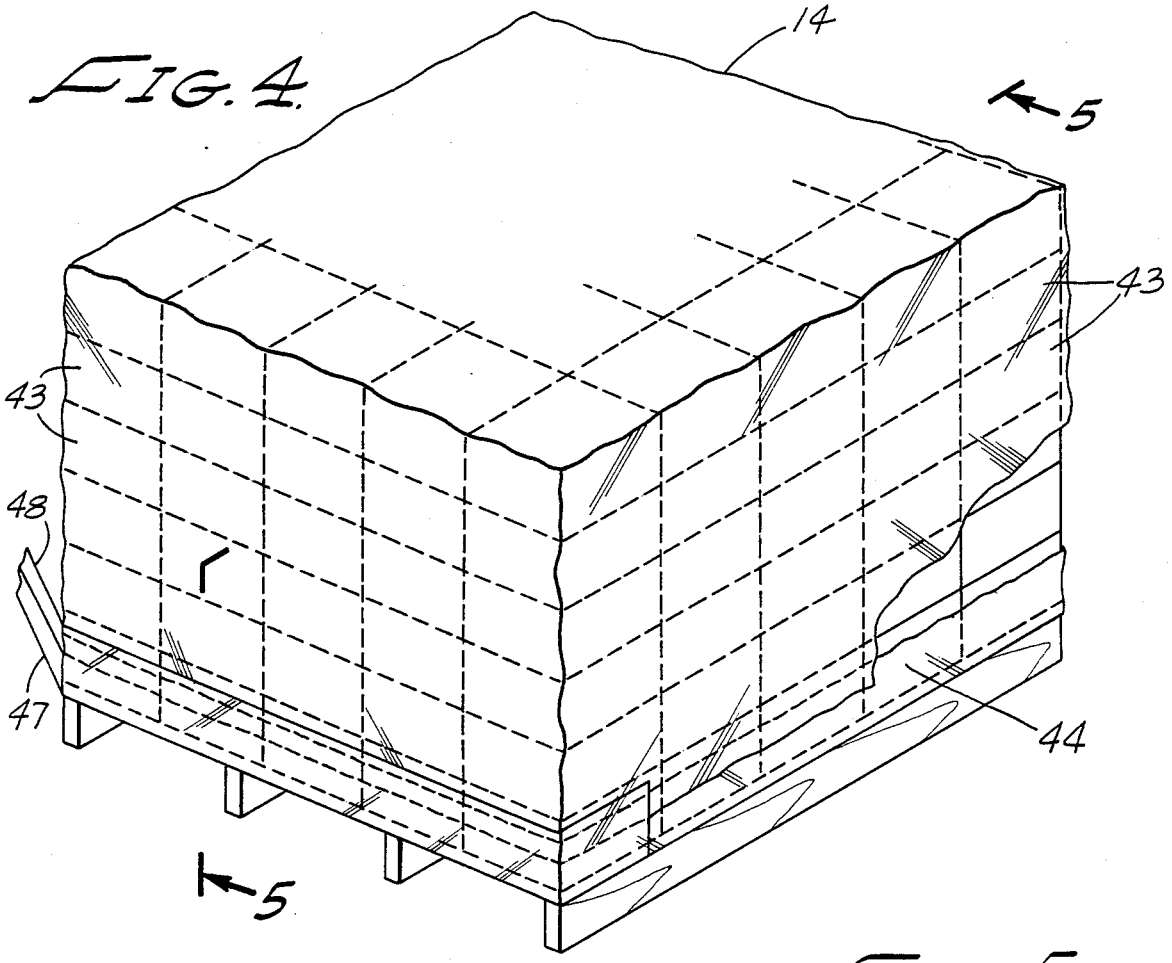
FIG. 4 is a perspective view of a loaded pallet and plastic bag sealed thereto.
Figure 5:
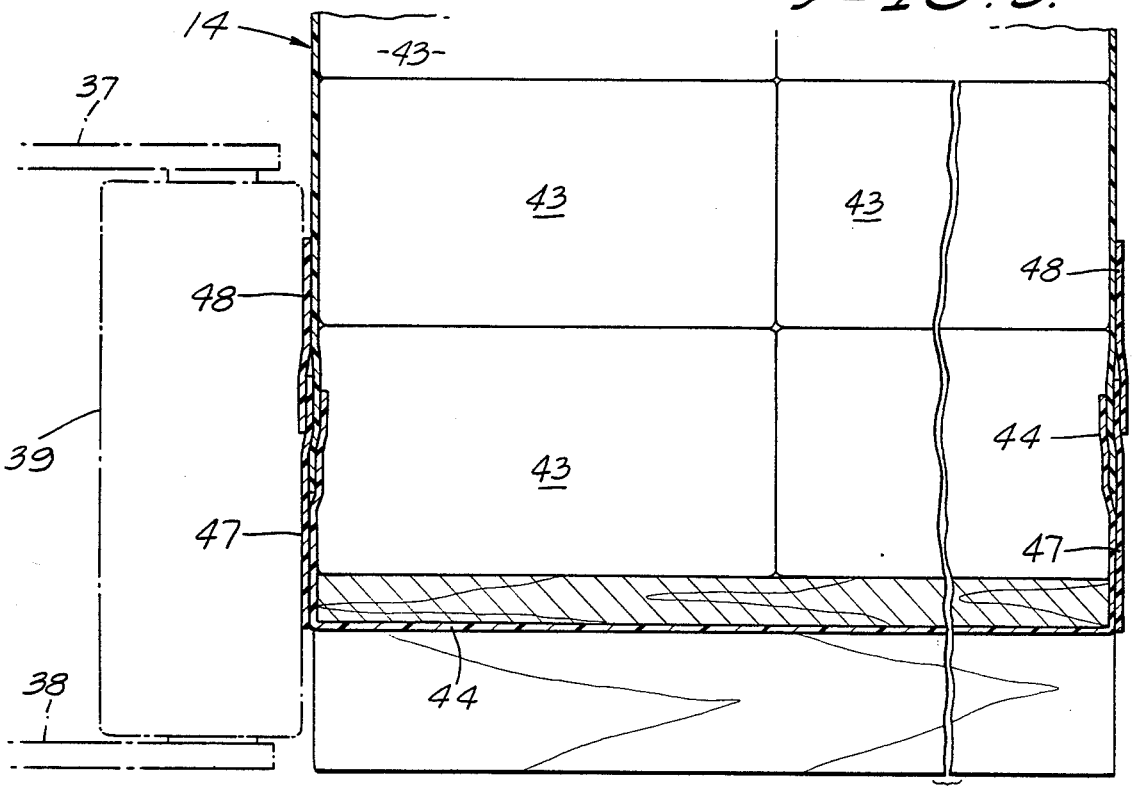
FIG. 5 is a sectional elevational, partially fragmentary view taken along the line 5—5 of FIG. 4.

With reference now to the drawing and particularly FIG. 1, the pallet sealing apparatus to be described is enumerated generally as at 10 and is seen to include in its major elements pallet support means 11 with an included rotatable table 12, and sealing tape dispensing means 13. In the usual situation, a loaded pallet 14 to be sealed is brought to the apparatus 10 and located on the table 12 by a fork truck, the latter being depicted schematically by a pair of lift forks 15.

The pallet support means 11 includes four legs or pedestals 16 which are adapted for floor or ground surface mounting. A generally horizontal support 17 is affixed to the upper ends of the legs 16 and carries the table 12 which is rotatably mounted thereon. Rotative power source 18 (e.g., electric motor) mounted on the undercarriage of the supporting means 11 provides selectively actuatable drive for the table 12.

Table 12 consists of a large metal plate the undersurface of which includes drive gearing 19 (FIG. 2) while the upper surface has first and second upstanding mutually orthogonal walls 20 and 21, respectively, arranged along two adjacent edges of the table. The upstanding walls serve as a means for locating the loaded pallet on the table preliminary to sealing. More particularly, the upstanding walls may be angle irons that are bolted to the table plate. It has been found that the loaded pallet may be located anywhere within 2–3 inches of the walls 20, 21 and still handled satisfactorily in accordance with the described method.

With reference to both FIGS. 1 and 3, a channel iron 22 anchored to the underside of the support means 11 extends horizontally outwardly therefrom, with an angle plate 23 and mounting block 24 affixed thereto. First and second cylindrical rods 25 and 26 are end mounted on the block 24 to extend vertically upward and as will be described serve as mounting means for tape rolls, the rods being adjustable to move the free end of each rod through a solid angle of approximately 9 degrees. Each cylindrical rod has a lower tapered spindle 27 secured to the rod, the spindle on rod 25 being lower than the one on rod 26. Further tapered spindles 28 are releasably located on the upper end portions of rods 25 and 26. In use, the pairs of spindles hold tape rolls therebetween and in that way locate them at a precise vertical position, while at the same time allowing the tape rolls to rotate. Moreover, the spindles provide tension to the tape as it is dispensed.

A further cylindrical rod 29 is end mounted onto channel iron 22 to extend vertically and substantially parallel to rods 25 and 26. A pair of spaced apart arms 30 and 31 extend at 90-degrees from rod 29 on the same side as rod 25 and include an idler roller 32 rotatably journaled between the arms. Roller 32 is generally parallel to rolls 25 and 26.

An arm 33 has one end pivotally connected to the undersurface of plate 23 as at 34 and its other end fixedly connected to a vertically upward extending member 35. A laterally extending, generally triangular-shaped bracket 36 anchored to the upper end of member 35 includes a pair of spaced apart mounting plates 37 and 38. A cylindrical pressure roller 39 is rotatably journaled to plates 37 and 38 and has its cylindrical axis arranged to be precisely vertical to the horizontal plane of table 12. The peripheral surface of the pressure roller is constructed of a relatively soft and pliable or resilient material such as rubber, for example.

A tension spring assembly 40 has one end connected to the arm 33 and its other end to a pull-rod 41 which is selectively actuated by a pneumatic drive cylinder 42 secured to the underside of plate 23. When the air cylinder is actuated the pressure is resiliently pulled toward the table and container 14. On the other hand, when the cylinder is released the pressure roller is free to swing away from the table 12 and container 14 a substantial distance.

This pressure roll tensioning as described in the previous paragraph with a pneumatic ram is primarily for use with a roller conveyor (FIG. 7) to be described. Where the loaded pallet is located on the table 12 by the two upstanding walls 20 and 21, the pneumatic ram is not used and the end of the coil spring 40 is directly anchored to the table underside.

In use of the apparatus as described to this point, a plurality of produce packages 43 are initially stacked onto the upper surface of a pallet having a generally rectangular plastic sheet 44 that is located beneath the pallet base upper surface and is integrally incorporated into the pallet construction. The sheet 44 is generally flat, its edge margins formed upwardly about the pallet base upper surface edges into a generally tray or open pan shape. The loaded pallet is then conveyed to the sealing apparatus 10 and located on the table 12, the pallet side edges being approximately squared with the upstanding walls 20 and 21. The composite tape strip is then pulled by hand toward the container 14 and affixed by hand to the container adjacent a corner and vertically so as to cover both the upper edge of the plastic sheet 44 and the outer edges of the wooden pallet base. The power source 18 is energized by actuating switch 46 and the table 12 is driven for one full revolution during which time tape is pulled off the two rolls on 25 and 26 and pressed as a composite tape onto the container by continuous pressure from the pressure roll 39. At the completion of taping for a full revolution, the rotational drive ceases by automatic or manual control and the tape is cut. The modified gaseous environment is then added to the sealed container in the manner disclosed in the previously referenced U.S. patent. That is, a sharp-ended nozzle interconnected via a flexible hose to a pressurized supply of the prescribed gas is used to pierce the plastic bag envelope and the gas is provided to the bag interior. After gasifying for a predetermined time, gas supply to the nozzle is shut off, the nozzle removed from the bag wall and the wall opening is sealed by a piece of tape, for example. The sealed and gasified pallet-container may now be removed from the sealing station to a location for storage or transportation, as desired.

As has been alluded to earlier herein, the primary aim here is to achieve a continuous gas-tight sealing relationship via the tape between the plastic lower edge and the plastic sheet on which the produce packages rest, and to do this reliably on a quantity production basis. It can be shown in the case of strawberries (and is believed to be applicable to other foodstuffs, also) that sealing in the manner described herein is a much more reliable sealing technique than by hand, in that a considerably higher percentage of machine sealed strawberry pallets after storage or shipment have $CO_2$ concentrations in the desired range of 8–26%. That is, the tape applied as herein is consistent, and uniform with less tendency to wrinkle or buckle with the resulting tendency to leak.

Reliability of sealing produces unexpected advantages, in that, first of all, less gas may have to be added to compensate for the leaks that could be expected to be encountered in hand-taped sealing. Due to the consistent and uniform processing forces and handling experienced with the described sealing, a thinner plastic stock may be used for the bag. Also, the greater gas migration of thinner plastic bag stock can be tolerated where reliability of good sealing is achieved.

To achieve reliability of sealing required, various preferred relationships of the sealing apparatus parts must be obtained. The most critical is of the tape rolls on the rods 25 and 26. First the lower tapered spindle 27 on the forward rod 25 is positioned to locate the tape roll lower edge at the desired lower position and fixed at that adjustment by a locking collar. Next, the lower spindle 27 on the rear rod 26 is set so that the tape on this rod will overlap the tape on the forward rod 25 (e.g., approximately ½ of an inch).

The rods or tape dispensing posts 25 and 26 have their lower ends mounted in block 24 such that the upper ends of the rods or posts may be adjustably positioned in an angle of ±4.5 degrees in any direction from 90 degrees with respect to the block. These adjustments enable achieving uniform tension in both tapes thereby avoiding tearing, folding and wrinkling of the tape which could produce gas leakage. The need for these adjustments arises from variations in pallet construction as well as unit stack variations.

Figure 6:
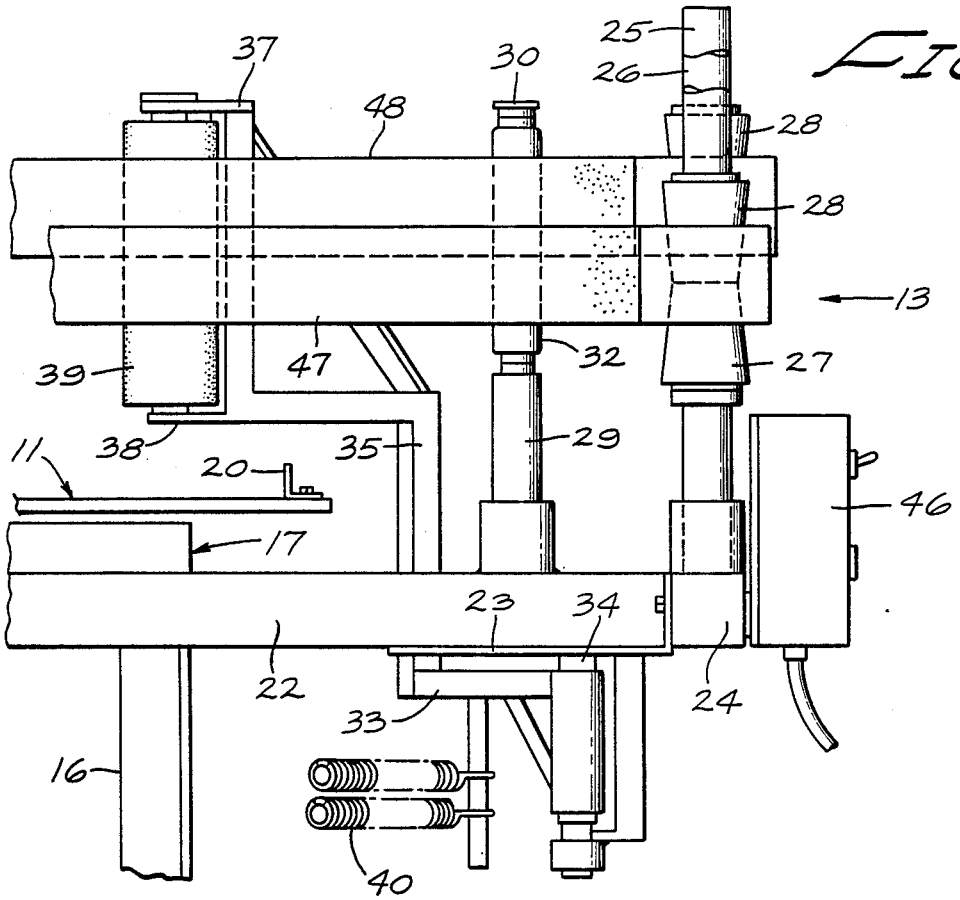
FIG. 6 is a sectional elevational view taken along the line 6—6 of FIG. 4.

The idler roller 32 joins the two strips of tape 47 and 48 as shown in FIG. 6 before they are applied to the pallet container. This is important in that attempts to simultaneously accomplish tape joining and sealing to the container produce a high incidence of undesirable wrinkling and folding. The idler roller also provides a uniform tensioning of the composite tape immediately before application to the container.

The idler roller requires proper adjustment in two respects. First of all, the upper end of post 29 is adjustable about the vertical through a solid angle of about 9 degrees in order to insure uniform tension through the width of the composite tape. Also, the idler is angularly adjustable about rod 29 as an axis, with best results being obtained when the roller 32 faces away from the pressure roller and a plane through the axes of the rod 29 and idler roller 32 is parallel to a wall 20, 21 while the latter is arranged at 90 degrees to the beam 22. This later relationship is depicted in FIG. 2.

It is also important that the tape be in tension and not slack, which condition is achieved by having the idler roller axis substantially off the line between the centerline of the pressure roller 39 and the forward dispensing rod 25 (FIG. 2).

In practical use of the described method and apparatus variations in the peripheral dimensions of the package stack as compared to the pallet periphery always occurs. The use of a single wide tape to seal the plastic bag to the pallet in this case frequently results in incomplete adhesion of the tape, tearing of the tape, wrinkling or folding where the dimensional differences are excessive. However, using the twin tape (composite tape) described the margin for error is substantially increased providing a gastight condition even where relatively great dimensional differences are encountered.

Figure 7:
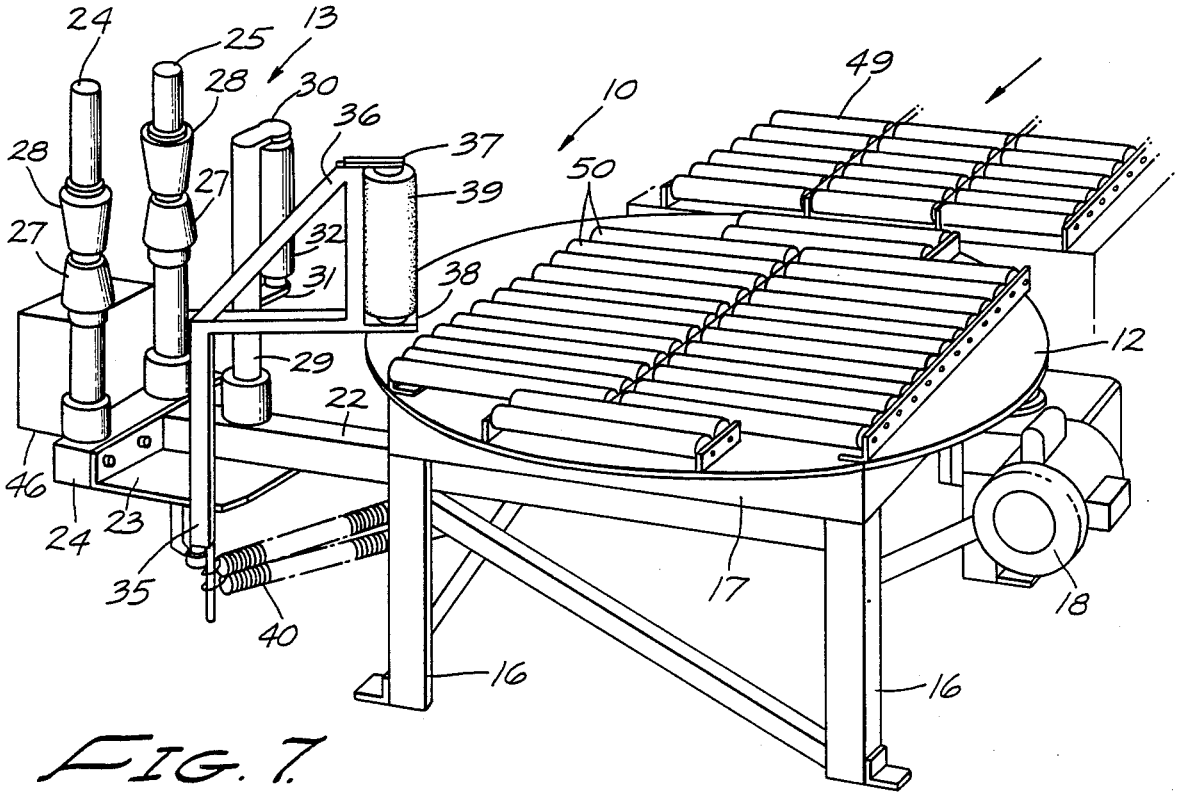
FIG. 7 depicts a perspective view of the apparatus of FIG. 1 used in conjunction with a roller conveyor.

As depicted in FIG. 7, it is contemplated that the loaded pallet may be brought to the tape sealing apparatus via a roller conveyor 49 (or optionally a chain conveyor) and located on rollers 50 arranged on table 12. At the conclusion of sealing, the sealed pallet may be removed via the same conveyor. As alluded to earlier herein, it is necessary in this case to provide a hydraulic ram 42 which will drive the pressure roller 39 against the loaded pallet preliminary to sealing. That is, since the loaded pallet is only approximately positioned on the turntable when it is moved there via the conveyor, the pneumatic ram serves to insure the tape contacts the flexible bag and plastic sheeting irrespective of minor variations in pallet location.

We claim:

1. A method of sealing an open plastic bag to a plastic sheet integrally related to a pallet base to provide a gastight container for respiring foodstuffs, which comprises the steps of:

locating the plastic sheet under the pallet base with sheet edge margins extending beyond the pallet base peripheral edges and upwardly;

positioning the open bag above the pallet base with the bag open edge margins extending downwardly and lying laterally opposite the plastic sheet upwardly extending edge margins;

unrolling two continuous strips of tape each having adhesive on one major surface;

passing the two strips over an idler roller with the said tape strips in edge overlapping relation to form a single composite tape strip;

adhering an end portion of the composite strip to adjacent edge margins of the plastic sheet and plastic bag about the peripheral edge of the pallet;

locating a second roller in continuous pressure exerting contact with the adhered end portion of the composite strip; and rotating the pallet, plastic bag and plastic sheet as a unit in such a plane as to apply a continuous strip of the composite tape about the bag and sheet edge margins and peripheral edge of the pallet to effect sealing while maintaining continuous pressure contact of the second roller across the full width of the composite tape.

2. A method of sealing as in claim 1, in which the pallet and plastic sheet are rectangular and the composite tape end portion is initially located immediately adjacent a corner of said plastic sheet and pallet with the remainder of the tape extending around the corner and at an angle less than 90 degrees to the pallet side.

3. A method of sealing as in claim 1, including the further steps of locating the pallet with foodstuffs, plastic bag and plastic sheet on a rotatable table and then selectively rotating said table.

4. Apparatus for gastight sealing a plastic bag about foodstuff containers carried on a pallet having a plastic sheet with edges extending upwardly about edges of the pallet and overlapping open edges of the bag, comprising:

a rotatable table having an upper support surface on which the pallet rests;

means for selectively rotating the table;

first and second spindle means carrying first and second rolls of tape, said tape having adhesive on one major surface;

an idler roller engaging tape from the first and second rolls urging them into adhesion along an edge margin and forming a tensioned composite tape;

a pressure roller engaging the composite tape and pressing the tape against the overlapping parts of the plastic bag and plastic sheet and an edge of the pallet during rotation of the table to effect sealing of the bag to the plastic sheet.

5. Apparatus as in claim 4, in which the first and second spindle means include respective first and second end mounted rods, each of said rods being adjustable to move the free end of the rod through a solid angle of approximately 9 degrees.

6. Apparatus as in claim 5, in which the idler roller includes means for adjusting the roller axis parallelism with the spindle means and for adjustably locating said idler roller with respect to said spindle means.

* * * * *